United States Patent [19]

Chetty

[11] Patent Number: 4,604,567

[45] Date of Patent: Aug. 5, 1986

[54] MAXIMUM POWER TRANSFER SYSTEM FOR A SOLAR CELL ARRAY

[75] Inventor: P. R. K. Chetty, Rockford, Ill.

[73] Assignee: Sundstrand Corporation, Rockford, Ill.

[21] Appl. No.: 540,418

[22] Filed: Oct. 11, 1983

[51] Int. Cl.[4] ..... G05F 5/00

[52] U.S. Cl. ..... 323/299; 323/271; 136/293

[58] Field of Search ..... 323/271, 283, 284, 285, 323/299, 303, 906; 136/293

[56] References Cited

U.S. PATENT DOCUMENTS

| | | | |
|---|---|---|---|
| 3,566,143 | 2/1971 | Paine | 323/283 |
| 4,272,806 | 6/1981 | Metzger | 363/21 |
| 4,390,940 | 6/1983 | Corbefin et al. | 363/132 |
| 4,468,569 | 8/1984 | Norris | 323/299 |

*Primary Examiner*—Peter S. Wong
*Assistant Examiner*—Judson H. Jones
*Attorney, Agent, or Firm*—Wood, Dalton, Phillip, Mason & Rowe

[57] ABSTRACT

A system for transferring maximum power from a solar cell array by loading the array in a manner which forces it to operate at its maximum power point. The system samples the open circuit voltage of the solar cell array to provide a signal proportional to the voltage of the array at its maximum power point. The sampled open circuit voltage is compared to the operating voltage of the solar cell array to provide an error signal which is proportional to the difference between the maximum power point voltage and the operating voltage of the array. The amount of power transferred from the array to a load is altered in accordance with the error signal to operate the array at its maximum power point.

12 Claims, 4 Drawing Figures

FIG. 2
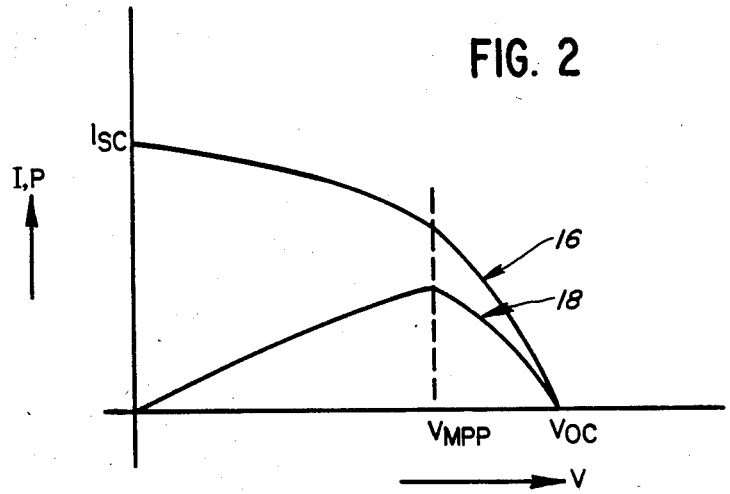
FIG. 3
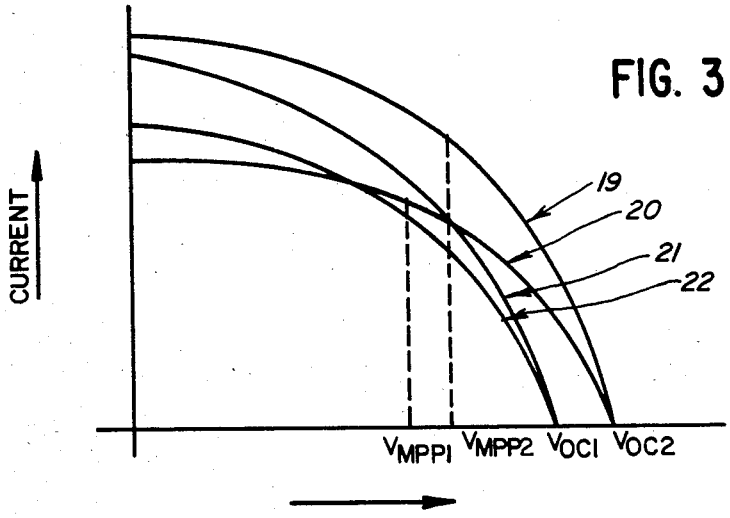
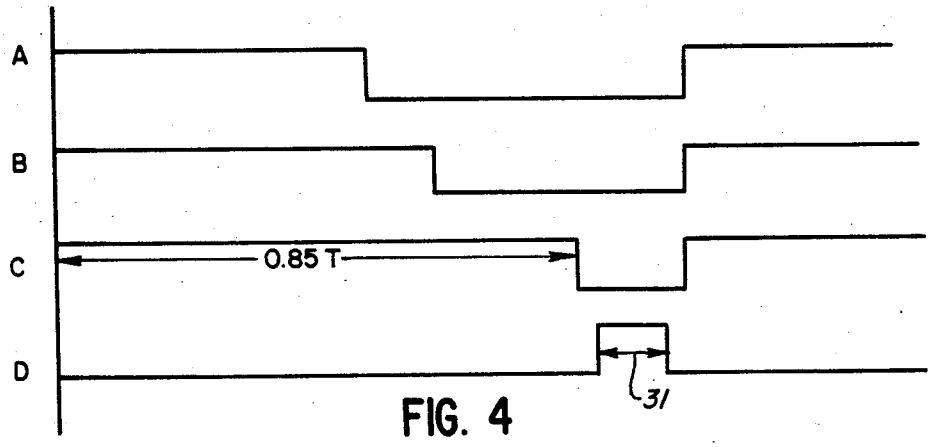
FIG. 4

MAXIMUM POWER TRANSFER SYSTEM FOR A SOLAR CELL ARRAY

TECHNICAL FIELD

The present invention relates to a power transfer system for a solar cell array and more particularly to a system for operating the solar cell array at its maximum power point to transfer maximum power from the array.

BACKGROUND OF THE INVENTION

In order to use solar radiation as an energy source, solar cell arrays have been used to convert the solar radiation into electrical energy. Where solar radiation is to be used as an energy source for a satellite or the like, it is critical that the solar cell array and system for transferring power therefrom be efficient, reliable and low in weight due to the typically large loads and power requirements of the satellite. In order to accomplish the first two objectives, a continuous transfer of the maximum available power from the solar cell array is typically attempted.

One known system for transferring the maximum available power from a solar cell array employs an auxiliary or separate reference solar array from which measurements are taken so that power to the load from the main solar cell array is not interrupted. The open circuit voltage of the auxiliary solar cell array is measured in order to sense the maximum power point of the auxiliary array and to track the maximum power point of the main solar cell array, the power transfer system forcing the main solar cell array to operate close to the tracked point. One major limitation of this power transfer system is that the auxiliary solar cell array must experience the same environment, temperature etc., as the main solar cell array in order to accurately track the main array's maximum power point.

In other known systems, measurements taken from the solar cell array itself have been used to sense the maximum power point of the array. These systems employ tracking circuits or scanning techniques to monitor various parameters of the solar cell array while the array is loaded. Such parameters include the solar cell array voltage and current, the dynamic impedance of the solar cell array and changes in power and current of the array. The tracking circuits of such systems are typically complex, costly and unreliable.

DISCLOSURE OF THE INVENTION

In accordance with the present invention, the disadvantages of prior power transfer systems for solar cell arrays as discussed above have been overcome. The power transfer system of the present invention loads the solar cell array in a manner which forces the array to operate at its maximum power point.

The maximum power transfer system samples the open circuit voltage of the solar cell array itself to provide a signal proportional to the voltage of the array at its maximum power point. The sampled open circuit voltage is compared to the operating voltage of the solar cell array to provide an error signal which is proportional to the difference between the maximum power point voltage and the operating voltage of the array. The amount of power transferred from the array to a load is altered in accordance with the error signal to force the solar cell array to operate at its maximum power point.

The solar cell array power transferring system affects a continuous transfer of the maximum available power from the solar cell array in an efficient, reliable manner.

These and other objects and advantages of the invention, as well as details of an illustrative embodiment, will be more fully understood from the following description and the drawings.

BRIEF DESCRIPTION OF THE DRAWINGS

FIG. 2 is a graph of the solar cell array current and power versus the solar cell array voltage, illustrating the maximum power point of the array;

FIG. 3 is a graph illustrating the current-voltage curves of a solar array operating under various temperature and incident energy conditions;

FIGS. 4A–4D illustrate various waveforms employed by the solar cell array maximum power transfer system of FIG. 1.

BEST MODE FOR CARRYING OUT THE INVENTION

Figure 1:
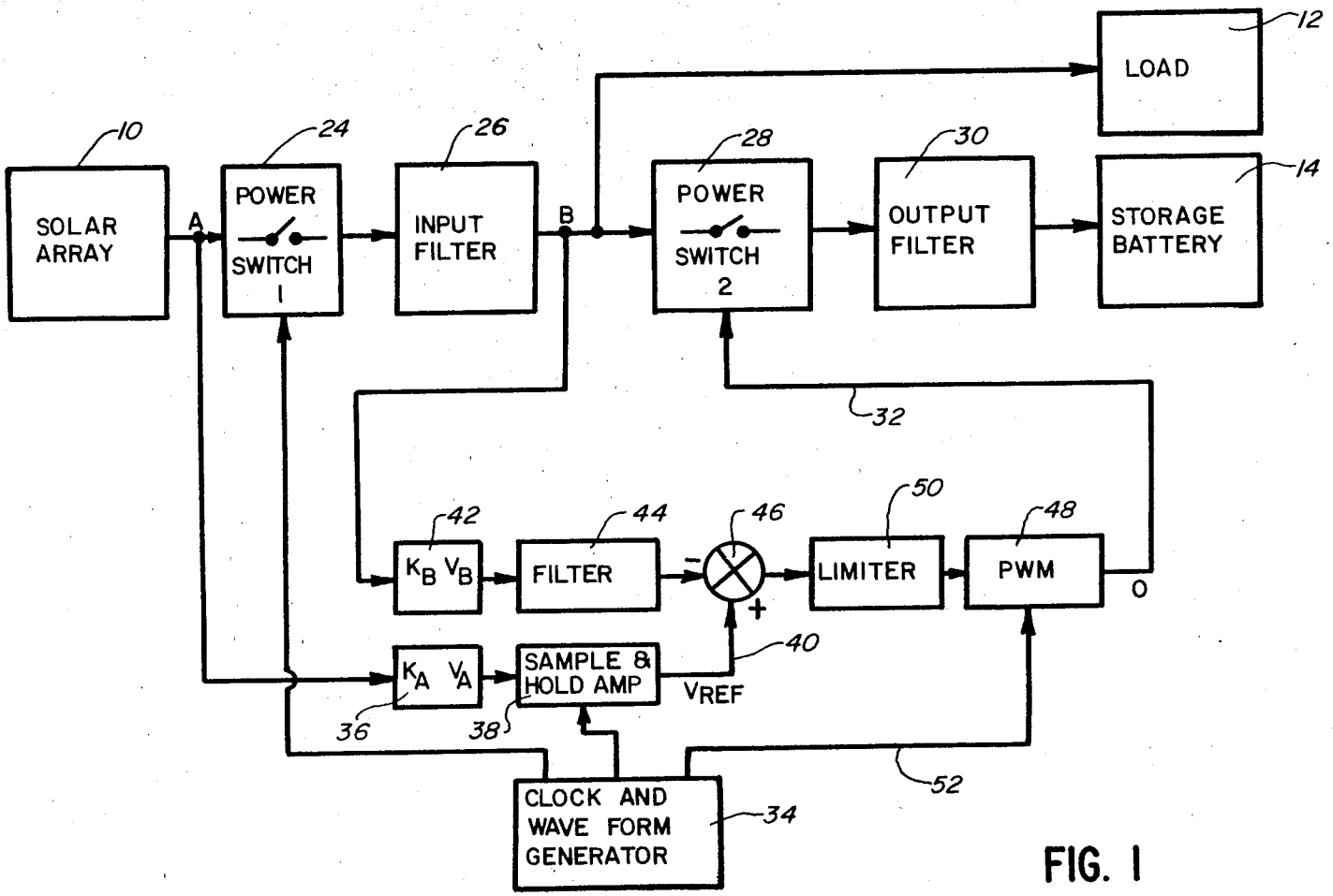
FIG. 1 is a block diagram of the solar cell array maximum power transfer system of the present invention.

The maximum power transfer system, as shown in FIG. 1, transfers power from a solar cell array 10 to a load 12. The system also transfers power from the solar cell array 10 to a storage battery 14 in a manner, as described in detail below, so as to operate the solar cell array at its maximum power point.

The maximum power point for a typical solar cell array is illustrated in FIG. 2 which depicts the current-voltage curve 16 and the power-voltage curve 18 for the array. The maximum power transfer system is based on the principle that the ratio of the maximum power point voltage, $V_{MPP}$, of the solar cell array to the open circuit voltage, $V_{OC}$, of the array is relatively constant for a given solar cell array over a wide range of environmental conditions. This property is illustrated in FIG. 3 which depicts the current-voltage curves for a solar cell array operating under four different environmental conditions. Curve 19 illustrates the current-voltage characteristics of a solar cell array subject to a low temperature but large incident energy whereas curve 20 illustrates the characteristics for the array when subject to a low temperature and low incident energy. The curve 21 illustrates the current-voltage characteristics for the solar array when subject to a high temperature and large incident energy whereas curve 22 illustrates the characteristics for the array when subject to a high temperature and low incident energy. It is seen from these curves that the ratio of the maximum power point voltage, $V_{MPP1}$ for curves 21 and 22 to the open circuit voltage $V_{OC1}$ the curves 21 and 22 is approximately the same as the ratio of the maximum power point voltage $V_{PP2}$ to the open circuit voltage $V_{OC2}$ for the curves 19 and 20.

The open circuit voltage, $V_{OC}$, of the solar cell array 10 is measured at point A by opening a power switch 24 which is connected between the array and an input filter 26. The input filter 26 is a low pass power filter which may be comprised of an inductor and shunt capacitor. The input filter 26 is coupled to the load 12 and supplies power thereto during the time that the power switch 24 is open. The input filter 26 is also coupled to the storage battery 14 through a second power switch 28 and an output filter 30 which is a low pass power filter similar to the input filter. The power switch 28 is controlled to open and close in response to a pulse width modulated waveform applied thereto on a line 32. The duty cycle of the pulse width modulated waveform applied on line 32 and thus the duty cycle of the power switch 28 is varied by the system so that the solar cell array 10 is loaded by the storage battery 14 in a manner which forces the array to operate at its maximum power point.

The power switch 24 is controlled by a waveform illustrated in FIG. 4D and applied to the switch from a clock and waveform generator 34, the switch 24 being open during the sampling period 31 of the waveform so that the open circuit voltage, $V_{OC}$ of the array may be measured at point A. The sampling period is 0.1T where T equals 1/F, F being the switching frequency of the system. If the switching frequency of the system is, for example, 10K cycles per second, the sampling period is approximately 10 μseconds. The sampling period is made relatively short so that power is supplied to the load 12 by the input filter 26 for a minimal amount of time. The sampling period, however, is made long enough so that voltage at point A has sufficient time to change from the operating voltage to the open circuit voltage during this period, the traverse time from the operating voltage to the open circuit voltage being less than 5 μsec for a square solar cell array.

The open circuit voltage at point A, $V_A$, is scaled at a block 36 by a constant $K_A$ and applied to a sample and hold amplifier 38 which is controlled by the waveform of FIG. 4D applied thereto from the clock and waveform generator 34. The reference voltage output from the sample and hold amplifier 38 on a line 40 is equal to $K_AV_A$ which is equal to $K_AV_{OC}$. Since the ratio of the maximum power point voltage to the open circuit voltage of the solar array, $V_{MPP}/V_{OC}$, is equal to a constant, $K_C$ and $K_C$ may be defined in terms of the constant $K_A$ as $K_C=K_A/K_B$, it is seen that the reference voltage output from the sample and hold amplifier on line 40 is also equal to $K_BV_{MPP}$.

The operating voltage of the solar cell array is measured at the output of the input filter 26, point B, during the time the power switch 24 is closed. It is noted that although the operating voltage of the array could be measured at the input of the filter 26, it is preferable that the voltage be measured at point B since voltage drops across the power filter are negligible and the output of the filter is smoother and more continuous than the input thereof. The operating voltage, $V_B$, is scaled at a block 42 by a constant $K_B$ and applied to a filter 44 which may be a low pass RC filter. The scaled operating voltage $K_BV_B$ is applied to the negative input terminal of a summing junction 46 to be compared to the reference voltage representing $K_BV_{MPP}$ which is output from the sample and hold amplifier 38 and applied to the positive input of the summing junction. The output of the summing junction 46 represents an error signal which is proportional to the difference between the maximum power point voltage of the solar cell array and the operating voltage of the array or $K_B(V_{MPP}-V_B)$.

The error signal output from the summing junction 46 is applied to a pulse width modulator 48 through a limiter 50. The pulse width modulator 48 is responsive to a waveform, as shown in FIG. 4A and applied thereto on line 52 from the clock and waveform generator 34, to generate a pulse width modulated waveform such as shown in FIG. 4B on line 32. The pulse width modulator 48 is also responsive to the error signal to vary the duty cycle of the waveform output on line 32 in an inversely proportional manner so as to increase or decrease the time during which the power switch 24 is closed and thus vary the amount of power transferred from the solar array 10 to the storage battery 14. The limiter 50 limits the error signal applied to the pulse width modulated waveform so that the maximum width of a pulse output from the modulator 48 is 0.85T as illustrated in FIG. 4C. The maximum width of the output from the pulse width modulated 48 is limited to 0.85T so that the power switch 28 will not be closed, drawing power from the input filter 26, during the time that the power switch 24 is open. An efficient use of the input filter 26 results since the filter need not store enough energy for both the load 12 and the storage battery 14.

The power transfer system loads the solar cell array in a manner, as illustrated with reference to FIGS. 1 and 2, to force the array to operate at its maximum power point. If the operating voltage of the solar cell array is less than the maximum power point voltage of the array, the output of the summing junction 46 is positive. The pulse width modulator 48 is responsive to a positive error signal to decrease the duty cycle of the waveform output of line 32 by an amount proportional to the error signal which causes the duty cycle of the power switch 28 to decrease. When the duty cycle of the power switch 28 decreases, the amount of current drawn from the solar array 10 decreases, tracking along the current-voltage curve 16 of FIG. 2 until the operating voltage of the array is equal to the maximum power point voltage $V_{MPP}$.

If the operating voltage of the solar cell array is greater than the maximum power point voltage, then the output of the summing junction 46 is negative. The pulse width modulator 48 is responsive to a negative error signal to increase the duty cycle of the waveform output on line 32 by an amount proportional to the error signal which causes the duty cycle of the power switch 28 to increase. When the duty cycle of the power switch 28 increases, the amount of current drawn from the solar array 10 increases, tracking along curve 16 until the operating voltage of the solar cell array drops to the voltage at the maximum power point. The power transfer system of FIG. 1 is thus responsive to the difference between the maximum power point voltage and the operating voltage of the array to vary the amount of power transferred to the storage battery 14 to force the solar cell array to operate at its maximum power point.

I claim:

1. In a system for transferring power from a solar array to a load, an improved means for operating said solar array at its maximum power point comprising:

means for sampling the open circuit voltage of the solar array;

means for sensing the operating voltage of said solar array;

means responsive to the open circuit voltage and the operating voltage of said solar array for providing an error signal;

means responsive to said error signal for altering a condition of said load to operate the solar array at its maximum power point.

2. The system of claim 1 wherein said altering means includes:

means for coupling said solar array to said load; and means responsive to said error signal for controlling the amount of time said solar array is coupled to said load.

3. In a system for transferring power from a solar array to a load, an improved means for operating the solar array at its maximum power point comprising:

means for sampling the open circuit voltage of the solar array to provide a signal proportional to the voltage of the solar array at its maximum power point;

means for sensing the operating voltage of said solar array;

means responsive to the open circuit voltage and the operating voltage of said solar array for providing an error signal proportional to the difference between said maximum power point voltage and said operating voltage; and means responsive to said error signal for altering the amount of power transferred to said load to operate the solar array at its maximum power point.

4. The system of claim 3 wherein said altering means includes:

a switch coupled between said solar array and said load; and means for controlling said switch to open and close, said control means being responsive to said error signal to vary the duty cycle of said switch.

5. The system of claim 4 wherein said control means is responsive to an error signal indicating that said operating voltage is greater than said maximum power point voltage to increase the duty cycle of said switch.

6. The system of claim 4 wherein said control means is responsive to an error signal indicating that said operating voltage is less than said maximum power point voltage to decrease the duty cycle of said switch.

7. The system of claim 4 further including means for limiting the maximum duty cycle of said switch.

8. In a system for transferring power from a solar array to a first and a second load, an improved means for operating said solar array at its maximum power point comprising:

means for sampling the open circuit voltage of the solar array;

means for sensing the operating voltage of the solar array;

means responsive to the open circuit voltage and the operating voltage of said solar array for providing an error signal; and means responsive to said error signal for altering the amount of power transferred to said first load to operate said solar array at its maximum power point.

9. The system of claim 8 wherein said sampling means includes a first switch coupled between said solar array and each of said loads, the open circuit voltage of said solar array being sampled during the time period when said first switch is open.

10. The system of claim 9 further including a filter coupled between said first switch and said second load, said filter supplying said second load with power when said first switch is open.

11. The system of claim 10 wherein said altering means includes a second switch coupled between said filter and said first load, power being transferred from said solar array to said first load when said second switch is closed.

12. The system of claim 11 further including means for preventing the second switch from closing when said first switch is open.

* * * * *